United States Patent [19]

Marshall et al.

[11] 4,265,216

[45] May 5, 1981

[54] SELF-CONTAINED EXOTHERMIC HEAT RECOVERABLE CHEMICAL HEATER

[75] Inventors: Larry J. Marshall, Menlo Park; Phillip C. Jensen, Fremont, both of Calif.

[73] Assignee: Raychem Corporation, Menlo Park, Calif.

[21] Appl. No.: 967,029

[22] Filed: Dec. 6, 1978

[51] Int. Cl.[3] ..... F24J 1/00; B65D 25/08

[52] U.S. Cl. ..... 126/263; 206/222; 132/36.2 B

[58] Field of Search ..... 126/263, 204; 206/219, 206/222; 132/36.2 B

[56] References Cited

U.S. PATENT DOCUMENTS

| | | | |
|---|---|---|---|
| 1,679,432 | 8/1928 | Lyon . | |
| 2,157,169 | 5/1939 | Foster . | |
| 2,510,211 | 6/1950 | Clecery | 206/219 |
| 2,573,791 | 11/1951 | Howells | 126/263 |
| 2,643,650 | 6/1953 | Miron . | |
| 2,680,063 | 6/1954 | Shapiro . | |
| 2,745,368 | 5/1956 | Klein . | |
| 3,022,209 | 2/1962 | Campbell . | |
| 3,175,558 | 3/1965 | Caillouette . | |
| 3,301,250 | 1/1967 | Glasser . | |
| 3,315,986 | 4/1967 | Quick . | |
| 3,328,136 | 6/1967 | Verakas . | |
| 3,756,389 | 9/1973 | Firth | 206/219 |
| 3,913,559 | 10/1975 | Dandliker | 126/263 |
| 3,924,603 | 12/1975 | Chapin . | |
| 3,983,994 | 10/1976 | Wyslatsky | 206/219 |
| 3,999,654 | 12/1976 | Pallack | 206/219 |
| 4,142,508 | 3/1979 | Watson | 126/263 |
| 4,170,296 | 10/1979 | Wetmore | 126/263 |

FOREIGN PATENT DOCUMENTS

| | | | |
|---|---|---|---|
| 391272 | 3/1973 | U.S.S.R. | 206/219 |

*Primary Examiner*—Herbert F. Ross

*Attorney, Agent, or Firm*—Lyon & Lyon

[57] ABSTRACT

A self-contained heat recoverable exothermic chemical heater to provide heat to a recoverable sleeve. The heat recoverable heater provides superior thermal contact as the sleeve recovers and, in particular, after recovery when additional heat is required to melt an adhesive. A first and second heat bag, each having a different chemical means disposed in its separate compartments, are bonded together. The separate compartments maintain the correct proportions and proper distribution of the chemical means for optimum mixing. The rupturable barrier enclosing each of the compartments can be almost totally removed to allow the rapid and complete mixing of the chemical means without permitting any of the chemical means to escape. The removal of the rupturable barrier causes the chemical means to mix, thereby generating heat. The adhesive partitioning the heat bags into separate compartments releases its bond as a result of the increasing temperature. This procedure is a continuous mass of hot chemicals, allowing the uniform application at heat to all surfaces of the heat recoverable sleeve.

18 Claims, 5 Drawing Figures

SELF-CONTAINED EXOTHERMIC HEAT RECOVERABLE CHEMICAL HEATER

BACKGROUND OF THE INVENTION

1. Field of the Invention

The present invention is directed to a self-contained exothermic chemical heater which is heat recoverable and has a plurality of separate compartments to maintain the proper mixing and distribution of the chemical means disposed therein. More specifically, the present invention relates to a self-contained heat recoverable chemical heater employed with a heat recoverable sleeve or other member.

2. Description of the Prior Art

Heat recoverable polymeric articles are widely known and find many uses. Such articles typically recover from their heat unstable states by being exposed to open flames or heat guns. In some environments, the use of an open flame would be hazardous and an electrical power source might not be available.

It has been proposed to use a self-contained chemical heater with heat recoverable tubular articles. See, for example, Chapin, U.S. Pat. No. 3,924,603 and Wetmore, patent application Ser. No. 3,563. A self contained chemical heater has many known advantages and uses since no flame is produced, and no source of electricity is required. Consequently, many such devices are known in the art. However, many difficulties would be encountered if these devices are used with heat recoverable sleeves or the like. Heat applied to a heat recoverable sleeve surrounding a substrate therein must be evenly and steadily applied during the entire recovery period to promote uniform recovery in all parts of the sleeve and to form an effective bond.

The chemical heaters known in the art, such as Chapin, U.S. Pat. No. 3,924,603, Caillouette, U.S. Pat. No. 3,175,558, and Foster, U.S. Pat. No. 2,157,169 encounter serious deficiencies in this regard. Since these chemical heaters are not heat recoverable themselves, they would begin to lose contact with the enclosed heat recoverable sleeve as they generate heat and the sleeve recovers. As the recovery of the sleeve continues, the gap between the chemical heater and sleeve would widen, thereby decreasing the amount of effective heat which reaches the sleeve. This would not only interfere with the uniform recovery of the sleeve, but also create an additional problem when a heat activatable adhesive is employed with the heat recoverable sleeve. Oftentimes such an adhesive is used to form an effective environmental seal. Continuous application of the heat after recovery of the sleeve causes the adhesive to flow and form such a seal. However, without continuous thermal contact, insufficient heat would reach the sleeve and adhesive, thereby hindering the intended flow of the adhesive. Thus, the effectiveness of such a chemical heater would be limited whenever a heat activatable adhesive is employed with the heat recoverable sleeve.

A related problem encountered in the art concerns the method of mixing the chemical means to provide heat. Ideally, when used with heat recoverable sleeves the chemical means should mix rapidly in order to avoid a prolonged heat build-up time and to minimize possible hot spots. Moreover, the chemical means should be quickly distributed throughout the heater to avoid localizing the application of heat to portions of the sleeve, which would cause nonuniform recovery. Nor is it desirable that agitation of the chemical heater be required to promote the mixing and distribution of the chemical means since the high temperatures which are required with heat recoverable members would make the heater extremely difficult to handle manually. However, the chemical heaters known in the art usually divide the different chemical means into two separate containers. Normally, one of the containers is inserted into the other, and the chemical means are mixed by applying sufficient pressure to cause the inner container to rupture. This means of mixing the chemicals, however, initially produces heat only at the spot where the inner container ruptures. This is caused by the incomplete or inefficient mixing of the chemicals. Therefore, the heaters known in the art frequently must be agitated in order to mix and properly distribute the chemical means in order to effectively achieve the heat which would be required for the uniform recovery of a heat recoverable article. Consequently, the time and effort which is required to attain the proper uniform temperature is detrimental to their use.

Typically, the chemical heaters known in the art use a single, continuous container to hold each chemical means. A recurring problem with such heaters is that, commonly, the chemical means will migrate to one portion of the container and harden or "set-up." When the barrier between the container is ruptured, the heat produced is localized to the area where the chemicals can be mixed. Therefore, the heater cannot uniformly apply the heat it generates to the substrate.

These types of problems limit the usefulness of self-contained chemical heaters known to the art as a means to achieve recovery of heat recoverable sleeves or other such substrates.

SUMMARY OF THE INVENTION

The present invention provides a self-contained heat recoverable exothermic chemical heater for use with the heat recoverable sleeves or the like. The heater comprises a first and a second heat bag which are made from a heat recoverable material. Each heat bag is divided into a plurality of separate compartments. The bags are joined by means of an adhesive and a rupturable barrier which seals the separate compartments and separates the heat bags such that the compartments overlap. The separate compartments of the first heat bag have a first chemical means disposed therein, while the second heat bag has a second chemical means disposed in its compartments. The first and second chemical means react to produce heat when they are mixed by rupturing the barrier. Preferably, the rupturable barrier comprises a plurality of tear strips which are positioned lengthwise over each of the separate compartments. A portion of each tear strip extends from one end of the heater to allow their easy removal, thereby opening the compartments and permitting the different chemical means to mix.

The chemical heater of the present invention maintains a uniform temperature over an extended period of time, and is particularly suited for use with a heat recoverable sleeve. The heat generated when the first and second chemical means are mixed not only causes the sleeve to recover, but the chemical heater recovers as well. This dual recovery maintains superior thermal contact between the chemical heater and the sleeve therein. This is particularly advantageous when an adhesive is employed with the heat recoverable sleeve to effect an environmental seal since heat must be continuously applied after the recovery of the sleeve in order to cause the adhesive to flow properly. The thermal contact supplied by the chemical heater of the present invention assures that sufficient heat will reach the adhesive to aid its intended flow.

Moreover, the use of a plurality of separate compartments in each of the heat bags presents several advantages. When the tear strips are removed many individual packets containing small quantities of the different chemical means are mixed. This assures that an optimum percentage of the different chemical means is thoroughly mixed, quickly and without agitation. The initial generation of heat therefore quickly reaches the proper temperature with a minimum build-up time. Also, the use of several separate compartments guards against the localization of heat by providing a proper distribution of the chemical means throughout the heater, thereby promoting the uniform application of the generated heat to the heat recoverable sleeve, as well as preventing all of the chemical means for migrating to one spot in the heat bag and "setting-up." Additionally, as the heat which is generated increases, the adhesive which separates each of the compartments releases its bond to form a continuous mass of hot chemicals in the heater. Thus, not only does the chemical heater of the present invention utilize separate compartments with discrete packets of chemicals for improved mixing and distribution, but it also provides a continuous mass of hot chemicals to uniformly apply the heat to all surfaces of the heat recoverable sleeve.

Finally, the tear strips employed in the rupturable barrier of the present invention can be almost totally removed by pulling them through a seal at one end of the heater. This method of rupturing the barrier between the different chemical means also promotes the faster and more complete mixing of the chemical means and prevents the escape of any chemicals when the barriers are ruptured. Thus, the chemicals are totally contained at all times for safety and ease of application.

The chemical heater of the present invention may be stored for long periods of time without losing its potency or presenting a danger of leakage. It therefore has a long shelf life and is always readily available to generate heat.

Accordingly, it is an object of this invention to provide a self-contained heat recoverable chemical heater which maintains superior thermal contact with a heat recoverable sleeve.

It is another object of this invention to provide a self-contained heat recoverable chemical heater which utilizes a plurality of separate compartments in each heat bag to maintain the correct distribution and proportion of the chemical means to improve the mixing of the chemical means.

It is a further object of this invention to provide a self-contained heat recoverable chemical heater which separates the individual compartments by means of an adhesive which releases its bond, thereby forming a continuous package of hot chemicals in the heater.

It is still another object of the present invention to provide a self-contained heat recoverable chemical heater which utilizes a rupturable barrier which can be almost totally removed without allowing any of the chemical means to escape, thereby permitting faster and more complete mixing.

The manner in which these and other objects and advantages of the invention are achieved will become apparent from the detailed description of the preferred embodiment and from the accompanying drawings which follow.

DETAILED DESCRIPTION OF THE PREFERRED EMBODIMENT

Figure 1:
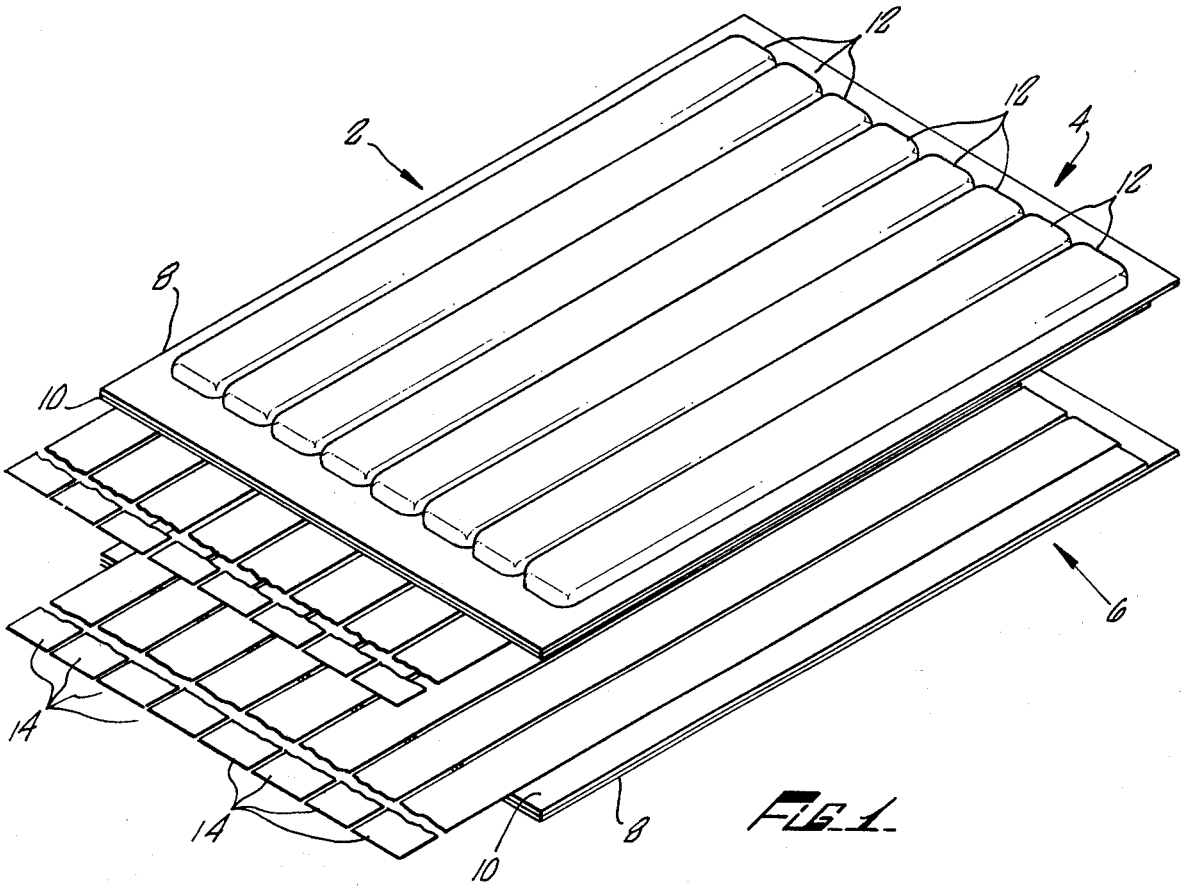
FIG. 1 is an exploded perspective view of a preferred embodiment of the self-contained heat recoverable chemical heater of the present invention, including a first and second heat bag having a rupturable barrier with a plurality of tear strips which enclose a plurality of separate compartments therein and extend outwardly from one end of the heater.

Turning in detail to the drawings, FIG. 1 shows a self-contained heat recoverable exothermic chemical heater 2 having a first heat bag 4 and a second heat bag 6. Each heat bag comprises a sheet of heat recoverable material 8 and a rupturable barrier sheet 10.

The heat recoverable sheet 8 may be made from a polyolefin such as, for example, ethylene vinyl acetate copolymer which has been rendered heat recoverable. Carbon black may be added to improve the thermal conductivity thereof. It has been found that the preferred amount of carbon black is about 15% to about 20% by weight. The heat recoverable sheet has a plurality of separate individual compartments 12 formed therein to maintain the correct distribution and proportions of the chemical means. These compartments may be formed while the sheet is being rendered heat recoverable, or they may be later formed in a sheet that has already been rendered heat recoverable. If the compartments are formed in a sheet which is already heat recoverable, care must be taken to ensure that the sheet does not prematurely recover as the compartments are formed. Each of these open compartments extends lengthwise along the sheet parallel to each other, leaving sufficient space at the ends of the sheet for an adhesive seal along each side of the heat recoverable sheet.

Figure 5:
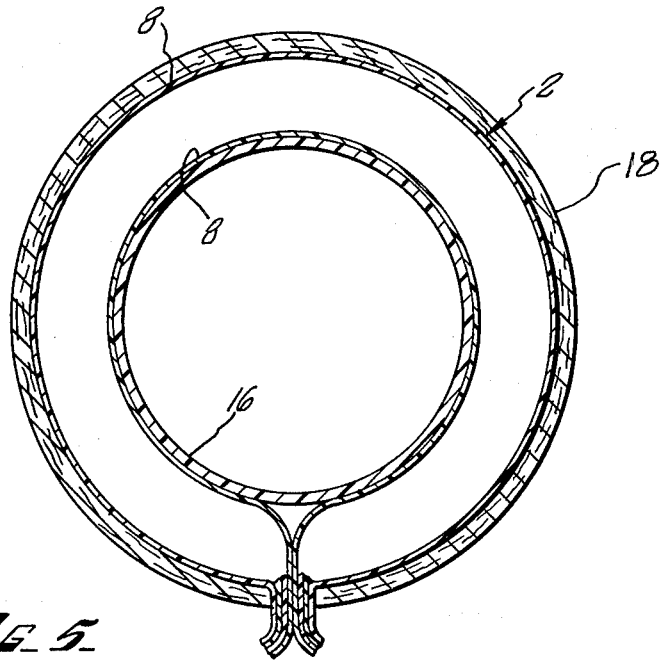
FIG. 5 is a cross-sectional view of the chemical heater of the present invention enclosing a heat recoverable sleeve therein after the tear strips have been removed and sufficient heat has been generated to cause the adhesive strips between each separate compartment to release their bonds, thereby forming a continuous mass of hot chemicals.

The rupturable barrier sheet 10 may be made from a polyethylene polyester laminate, and is bonded by means of an adhesive to the rear of the heat recoverable sheet, thereby enclosing all of the separate compartments. A typical adhesive employed in the present invention must be intended for high temperature uses and have high peel strength, e.g., General Electric Adhesive SR-575. The adhesive is placed between each of the compartments as well as along each of the borders on the heat recoverable sheet. However, the width of the adhesive strip placed along the borders of the heat recoverable sheet is much greater than the width of the adhesive strip placed between the compartments. Since the adhesive strip between each compartment will be attacked by heat from two directions when the different chemical means in the separate compartments mix, the adhesive will gradually disintegrate until it releases its bond. This results in a continuous mass of hot chemicals in the heater as shown in FIG. 5. However, since the adhesive strip along the borders of the heat recoverable sheet is of a greater width and is attacked by heat from only one side, the adhesive along the borders does not entirely release its bond. Therefore, the chemical means are always safely contained.

Figure 2:
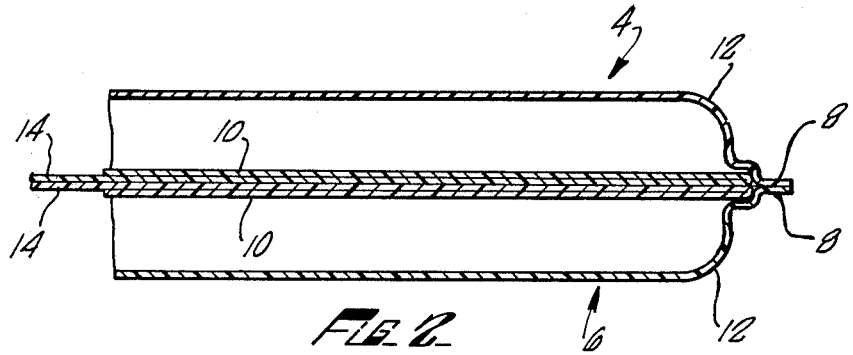
FIG. 2 is a longitudinal sectional view showing the first and second heat bags attached together such that the compartments overlap with the rupturable barriers adjacent to each other and the tear strips aligned in the same direction.
Figure 3:
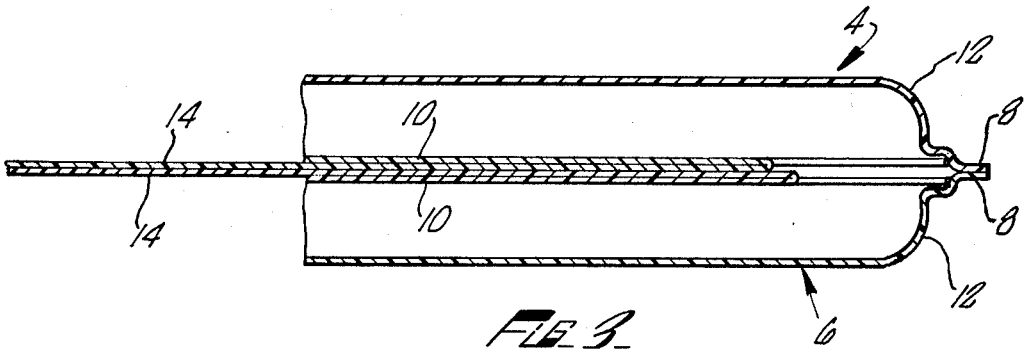
FIG. 3 is a longitudinal sectional view showing the rupture of the barrier between the compartments by the removal of the tear strips to allow the different chemical means contained in the separate compartments of the first and second heat bags to mix and generate heat.

The rupturable barrier sheet in the preferred embodiment has a plurality of tear strips 14 as a means for rupturing the barrier sheet. The tear strips are merely a continuation of the barrier sheet itself which are folded back over the sheet. They are therefore of the same material as the barrier sheet and are integral therewith. The tear strips are formed by taking a laminate sheet which is slightly larger than twice the dimensions of the portion of the barrier sheet which is actually bonded to the rear of the heat recoverable sheet, and cutting away narrow strips of the laminate which correspond to the spaces between the compartments of the heat recoverable sheet, leaving a solid portion which is bonded to the heat recoverable sheet. Thus, there remains a laminate sheet which has a plurality of separate "finger" projections corresponding to the number of compartments in the heat recoverable sheet. These projections, or tear strips, are folded back over the remaining portion of the laminate sheet to form the rupturable barrier having a plurality of tear strips. Each of the tear strips is positioned lengthwise over one of the enclosed compartments such that the compartments can be opened by removal of the tear strips, as shown in FIG. 2. Each of the tear strips also has a portion which extends outwardly from one end of the heater after it is folded back along the barrier sheet. The barrier sheet is ruptured by grasping this portion of the tear strips and pulling each of the tear strips until they are removed, or almost totally removed, from the heater. This opens the compartments which are positioned under the tear strips and permits the chemical means contained therein to mix with the different chemical means contained in the compartments of the second heat bag which are positioned adjacent thereto, as shown in FIG. 3. Since the tear strips can be almost totally removed from the heater the different chemical means can be mixed quickly and more completely without the necessity of agitating the heater.

A first heat bag 4, as described above, having a first chemical means disposed in each compartment therein, and a second heat bag 6 having elements corresponding to the first heat bag but with a second, different chemical means disposed in each compartment therein, are bonded to each other to form the chemical heater. The barrier sheets of each heat bag are aligned adjacent to each other with the portion of the tear strips which extends outwardly from the heat bags extending from the same end of the heater. A strip of adhesive, or similar sealing means, is placed along the remaining three ends to bond the first and second heat bags together.

A sealing means comprising a strip of a closed-cell foam of heat resistant capability, such as a silicone foam, and a semi-rigid plastic strip are attached to the end of the heater through which the tear strips are removed to prevent the escape of any of the chemical means employed in the heater when the barrier is ruptured by removing the tear strips. The foam is placed between one of the heat bags and all of the tear strips and the remaining heat bag. The plastic strip is placed at this same end and is positioned along the surface of the heat bag which contacts the surface of the enclosed heat recoverable sleeve. The foam and the plastic strip are held in place by means of staples or the like which do not extend through the tear strips.

The first and second chemical means may be a variety of combinations of various chemical reactants which will produce heat when mixed together. Magnesium chloride and ethylene glycol are presently preferred. When these two chemicals are mixed in the heater of the present invention, a temperature between 420° to about 450° F. is reached in approximately 3 minutes, and is maintained for approximately 10 to 15 minutes thereafter before the temperature begins to decrease. The exact times will vary depending upon the amounts of the chemicals which are mixed together.

Figure 4:
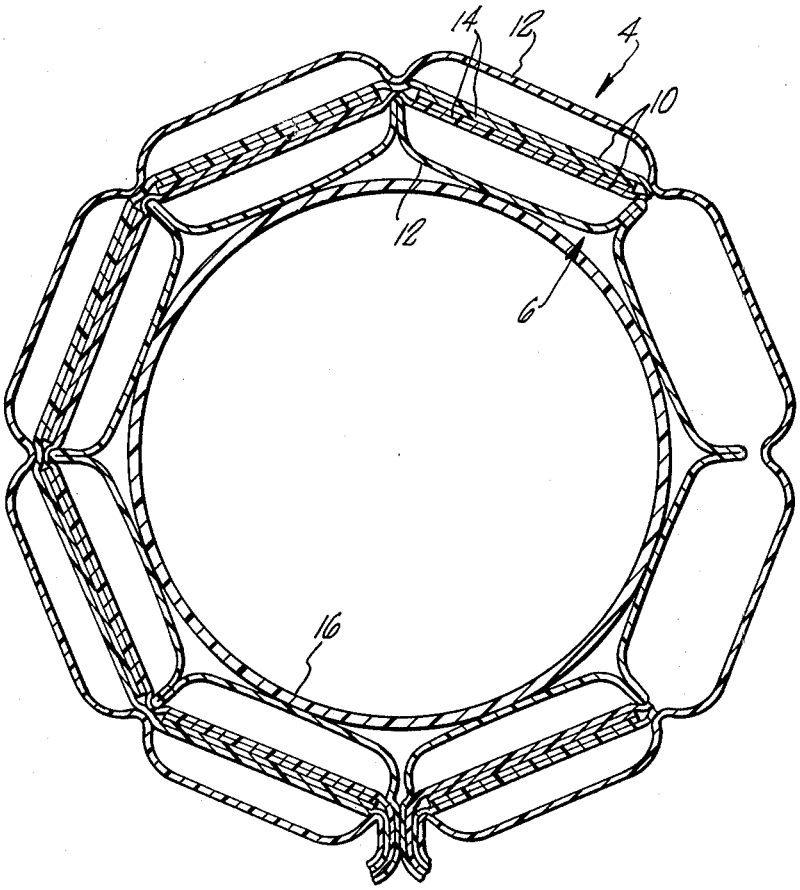
FIG. 4 is a cross-sectional view of the chemical heater of the present invention enclosing a heat recoverable sleeve therein before the removal of all of the tear strips.

Before it can be used, the chemical heater of the present invention must be wrapped around a heat recoverable sleeve or member. This causes the heat bags to stretch tightly against the plastic strip, thereby compressing the foam against the tear strips. As the tear strips are then pulled through the foam and out of the heater the foam will expand to fill the space previously occupied by the now-removed tear strips. This action seals that end of the heater to prevent any of the chemical means from escaping. FIG. 4 shows the chemical heater of the present invention properly in place surrounding a heat recoverable sleeve 16. The tear strips enclosing two of the separate compartments in each of the heat bags have been removed to permit the different chemical means contained therein to mix. As the remaining tear strips are removed, the chemical means quickly mix such that the temperature required to shrink the heat recoverable sleeve is reached with a minimal build-up time. The heat generated causes the adhesive seal between the compartments to gradually disintegrate until it releases its bond. This produces a continuous mass of hot chemicals which provides the uniform application of heat to all surfaces of the heat recoverable sleeve as shown in FIG. 5, rather than maintaining discrete packages of chemicals separated by partitions. Additionally, the heat causes the chemical heater of the present invention to recover, thereby maintaining proper thermal contact with the heat recoverable sleeve as the sleeve recovers.

The exothermic chemical heater of the present invention may also be enclosed within a protective covering 18, such as a cardboard shell, to provide insulation from the high temperatures which are generated by the heater.

While the preferred application of this invention has been shown and described, it would be apparent to those skilled in the art that many more modifications are possible without departing from the inventive concept herein described. The invention therefore is to be limited only by the lawful scope of the claims which follow.

We claim:

1. A self-contained heat recoverable exothermic chemical heater comprising:

a first and a second heat bag, each of said heat bags including a heat recoverable sheet having a plurality of separate compartments therein and a rupturable barrier sheet bonded to the rear of each heat recoverable sheet, thereby enclosing all of said compartments, said compartments having a continuous strip of adhesive placed between adjacent compartments to form a bond between said heat recoverable sheets and said rupturable barrier sheets which seals each of said compartments, each of said rupturable barrier sheets having a plurality of integrally extending tear strips, each of said tear strips being positioned lengthwise over a compartment and having a portion thereof which extends outwardly from one end of said heater, said first and second heat bags being joined together such that said rupturable barrier sheets separate said heat bags and the compartments in the heat recoverable sheet of the first heat bag overlap the compartments in the heat recoverable sheet of the second heat bag, said rupturable barrier sheets providing access to each pair of overlapping compartments by removing said tear strips;

a first chemical means disposed in each compartment of said first heat bag;

a second chemical means disposed in each compartment of said second heat bag which reacts with said first chemical means to produce heat when mixed by removing said tear strips, said adhesive bond between adjacent compartments disintegrating as the heat produced increases until said bond is released;

means for sealing the end of said chemical heater from which said tear strips are removed to prevent escape of said first and second chemical means.

2. A self-contained exothermic heat recoverable chemical heater as in claim 1 wherein said heat recoverable sheet is a polyolefin.

3. A self-contained exothermic heat recoverable chemical heater as in claim 2 wherein carbon black is added to said heat recoverable sheet to improve the thermal conductivity thereof.

4. A self-contained exothermic heat recoverable chemical heater as in claim 1 wherein said first chemical means is magnesium chloride.

5. A self-contained exothermic heat recoverable chemical heater as in claim 1 wherein said second chemical means is ethylene glycol.

6. A self-contained exothermic heat recoverable chemical heater as in claim 1 wherein said means for sealing said heater includes a strip of closed-cell foam having heat resistant capability and a semi-rigid plastic strip.

7. A self-contained exothermic heat recoverable chemical heater as in claim 6 wherein said closed-cell foam is a silicone foam.

8. A self-contained exothermic heat recoverable chemical heater as in claim 1 wherein an outer protective covering surrounds said attached first and second heat bags to provide insulation.

9. A self-contained exothermic heat recoverable chemical heater as in claim 8 wherein said outer protective covering is a cardboard shell.

10. A self-contained exothermic heat recoverable chemical heater as in claim 1 in combination with a heat recoverable member which is enclosed by wrapping said heater around said member.

11. A self-contained exothermic heat recoverable chemical heater comprising:

a first and second heat bag, each of said heat bags including a heat recoverable sheet having a plurality of separate open compartments extending lengthwise inwardly from the ends thereof and a rupturable barrier sheet sealed to the rear of each said heat recoverable sheet to enclose said compartments, said barrier sheets having a plurality of integrally extending tear strips, each of said tear strips being positioned lengthwise over one of said enclosed compartments such that said compartments are opened by the removal of said tear strips, each of said tear strips having a portion extending outwardly from one end of said heater, each said barrier sheet being sealed to a respective one of said heat recoverable sheets by means of a continuous strip of adhesive placed along each edge of each said heat recoverable sheets and placed between each of said enclosed compartments to form a bond therebetween, the strip of adhesive placed along the edges of said heat recoverable sheet being substantially greater in width than the strip of adhesive placed between each compartment, said second heat bag being joined to said first heat bag by aligning the barrier sheets of each heat bag adjacent to each other such that the compartments in the heat recoverable sheet of the first heat bag overlap the compartments in the heat recoverable sheet of the second heat bag and the portion of said tear strips of each rupturable barrier extending outwardly from said one end thereof are aligned with each other in the same direction, and placing a continuous strip of adhesive along the remaining three ends to form a bond between said first and second heat bags;

a sealing assembly including a sheet of closed-cell foam of heat resistant capability placed along the end from which said tear strips extend and positioned between one of said heat bags and all of said tear strips, and a semi-rigid plastic strip extending along this same end and positioned on the external surface of one of said heat bags, said closed-cell foam and said plastic strip being attached to the first and second heat bags such that said tear strips are not attached thereto;

a first chemical means disposed in each compartment of said first heat bag;

a second chemical means disposed in each compartment of said second heat bag which reacts with said first chemical means to produce heat when mixed by removal of mixed tear strips, said adhesive bond between each of the compartments disintegrating as the heat produced increases until said bond is released;

an outer protective covering which surrounds said heater to provide insulation.

12. A self-contained exothermic heat recoverable chemical heater as in claim 11 wherein said heat recoverable sheet is a polyolefin.

13. A self-contained exothermic heat recoverable heater as in claim 12 wherein carbon black is added to said heat recoverable sheet to improve the thermal conductivity thereof.

14. A self-contained exothermic heat recoverable chemical heater as in claim 11 wherein said first chemical means is magnesium chloride.

15. A self-contained exothermic heat recoverable chemical heater as in claim 11 wherein said second chemical means is ethylene glycol.

16. A self-contained exothermic heat recoverable chemical heater as in claim 11 wherein said closed-cell foam is a silicone foam.

17. A self-contained exothermic heat recoverable chemical heater as in claim 11 wherein said outer protective covering is a cardboard shell.

18. A self-contained exothermic heat recoverable chemical heater as in claim 11 in combination with a heat recoverable member which is enclosed by said heater by wrapping said heater around said member.

* * * * *